United States Patent [19]

Dodge et al.

[11] Patent Number: 4,678,398

[45] Date of Patent: Jul. 7, 1987

[54] HIGH EFFICIENCY TRANSONIC MIXED-FLOW COMPRESSOR METHOD AND APPARATUS

[75] Inventors: John L. Dodge, Phoenix; Duane B. Bush, Tempe; Georges A. Pechuzal, Scottsdale; Ambrish Ravindranath, Mesa, all of Ariz.

[73] Assignee: The Garrett Corporation, Los Angeles, Calif.

[21] Appl. No.: 732,195

[22] Filed: May 8, 1985

[51] Int. Cl.[4] ..... F04D 21/00

[52] U.S. Cl. ..... 415/181; 415/210

[58] Field of Search ..... 415/181, 207, 213 C, 415/210, 119; 416/223 R

[56] References Cited

U.S. PATENT DOCUMENTS

| | | | |
|---|---|---|---|
| Re. 29,128 | 2/1977 | Sohre | 415/181 X |
| 2,435,236 | 2/1948 | Redding | 415/181 |
| 2,570,081 | 10/1951 | Szczeniowski | 415/181 |
| 2,575,682 | 11/1951 | Price | 415/181 |
| 2,609,141 | 9/1952 | Aue | 415/210 |
| 2,648,492 | 8/1953 | Stalker | 415/210 |
| 2,648,493 | 8/1953 | Stalker | 415/181 |
| 2,710,136 | 6/1955 | Ganahl et al. | 415/181 |
| 2,743,053 | 4/1956 | Gregory et al. | 415/207 X |
| 2,806,645 | 9/1957 | Stalker | 415/181 |
| 2,940,659 | 6/1960 | Stalker | 415/213 C |
| 2,955,747 | 10/1960 | Schwaar | 415/181 |
| 2,974,857 | 3/1961 | Schwaar | 415/181 |
| 2,974,858 | 3/1961 | Koffel et al. | 415/181 |
| 2,991,929 | 7/1961 | Stalker | 415/181 |
| 3,173,604 | 3/1965 | Sheets et al. | 415/213 C |
| 3,420,435 | 1/1969 | Jarosz et al. | 415/210 |
| 3,719,426 | 3/1973 | Friberg et al. | 415/181 X |
| 3,832,089 | 8/1974 | Moellmann | 415/207 |
| 4,027,997 | 6/1977 | Bryans | 415/207 |

*Primary Examiner*—Robert E. Garrett
*Assistant Examiner*—Joseph M. Pitko
*Attorney, Agent, or Firm*—Terry L. Miller; ALbert J. Miller

[57] ABSTRACT

Method and apparatus for compression of elastic fluids such as air in a rotary continuous flow process particularly of interest in the turbomachinery field. Resulting structure has an envelope or outer diameter favorably comparable with axial flow compressors and a static pressure ratio, cost, and resistance to FOD comparable to centrifugal compressors. Jet propulsion engine apparatus incorporating such a compressor is also presented.

53 Claims, 5 Drawing Figures

HIGH EFFICIENCY TRANSONIC MIXED-FLOW COMPRESSOR METHOD AND APPARATUS

The U.S. Government has rights in this invention pursuant to Contract No. F33615-79-C-2028 awarded by the U.S. Air Force.

BACKGROUND OF THE INVENTION

The field of the present invention is compression or pressurization method and apparatus of rotary continuous-flow type for use with elastic fluids such as air.

More particularly, the present invention is concerned with turbomachinery compressor method and apparatus of a type having characteristics both of known axial-flow and known centrifugal-flow types, but differing quite remarkably in structure and method of operation from either of these known turbomachinery types. Consequently, the present invention is related in a general way to known turbomachinery compressor method and apparatus commonly grouped under the genus of mixed-flow axial-centrifugal type.

The present invention is also related to a combustion turbine engine employing turbomachinery compressor method and apparatus of the type described above.

The cost and reliability of modern combustion turbine engines are both strongly affected by the number of compression stages, blade rows, or acceleration/diffusion operations in the compressor sections of these engines. Accordingly, reducing the number of compressor stages has been a long-recognized objective in the field of turbomachinery design, and particularly in the jet propulsion field.

The conventional way to achieve a reduction in compressor stages has been to use one or more centrifugal-flow compressor stages in place of a greater number of axial-flow compressor stages. Centrifugal compressor stages in comparison with axial-flow compressor stages are recognized as offering a lower cost and higher static pressure ratio. They have also been recognized as offering superior resistance to damage from ingestion of foreign objects (hereinafter, foreign object damage, FOD) and superior tolerance to distortion or nonuniformity of inlet air flow distribution. However, centrifugal compressors are in general slightly less efficient and have a larger outer diameter than comparable axial flow compressor.

Balancing all these factors, early developments of jet engines for aircraft uses concentrated on axial-flow compressor stages and avoided centrifugal compressor designs primarily because of the adverse engine envelope or increased frontal area which would have resulted from the use of centrifugal compressor stages. Such increased envelope of centrifugal compressors is attributable primarily to the substantial radius change in the rotor of the centrifugal compressor stage. This radius change results in an outlet air flow having, in addition to a substantial tangential velocity component, a high radially outward velocity component. Conventionally, this high radially outward air flow velocity component dictated a stationary diffuser disposed annularly around and radially outwardly of the compressor rotor. It is this diffuser structure primarily which results in the comparatively large outer diameter of centrifugal compressors.

The theoretical possibility of structuring the rotor of a centrifugal compressor with an outlet portion turning the outlet flow toward an axial direction has been recognized in the pertinent art for many years. Such a rotor construction would allow the diffuser structure to be disposed axially of the rotor rather than radially outwardly thereof and would result in a decreased overall outer diameter. Such compressors are depicted by the U.S. Pat. Nos. 2,570,081; to B. Szczeniowski; and 2,648,492; 2,648,493; to E.A. Stalker. However, it has been learned from practical experience that substantial turning of a centrifugal compressor flow from radially outwardly toward the axial direction within the rotor itself as taught by these patents occasions such large aerodynamic losses that these designs are unattractive by contemporary performance standards.

Another alternative proposal has been to structure a compressor rotor according to centrifugal-flow teachings, but with the air flow through the rotor turning only partially toward the true radial direction despite enjoying a significant increase of radial dimension in traversing the rotor. The flow from such a mixed axial-centrifugal rotor is then received by a modified channel or pipe diffuser which initially turns the flow from axially and radially outward to, or past, the axial direction to flow axially, and perhaps radially inwardly, all substantially without diffusion. The diffuser also includes divergent pipe diffuser channels which extend a considerable distance in the downstream axial direction, and which thus contribute to an undesirably long axial dimension for such a compressor stage. U.S. Pat. No. 2,609,141, of G. Aue proposes a mixed-flow compressor of the above-described type wherein it is proposed the modified channel pipe diffuser may relieve only the radially outward, or both radially outward and tangential components of air flow velocity exiting from the rotor. However, practical experience has again shown that the radially outward component of air flow leaving such a proposed rotor is of sufficient magnitude that when the modified channel pipe diffuser is configured to relieve only this radially outward component, performance of the compressor is unacceptably low by contemporary standards. Configuration of the channel pipe diffuser to relieve both radial and tangential velocity components of air flow from the compressor rotor further increases the performance shortfall of such a compressor by current standards.

Yet another theoretical proposal has been to structure a compressor with what is essentially an axial-flow rotor having an increase of radial dimension from inlet to outlet, at least with respect to the mean radius of bulk flow through the rotor. In theory, such a compressor rotor enjoys, at least to some small degree, the advantages which centrifugal compressor rotors derive from their increase of radial dimension from inlet to outlet. Such a compressor is proposed by the U.S. Pat. No. 2,806,645, to E.A. Stalker. Again, practical experience has shown such a proposed compressor to be theoretically unsound and to offer performance far short of contemporary standards.

SUMMARY OF THE INVENTION

In view of the above, the objects broadly stated for a compressor according to this invention are to achieve a compressor envelope or outer diameter the same as, or only slightly larger than, that offered by the best conventional axial-flow compressor technology; to achieve a static pressure ratio, cost, inlet distortion tolerance and resistance to damage from ingestion of foreign objects (FOD) substantially the same as that offered by the best conventional centrifugal flow compressor technology; and to achieve a compressor efficiency at least equal to that of the conventional centrifugal compressors, and preferably approaching the efficiency of conventional axial-flow compressors.

With greater particularity, the present invention contemplates a transonic mixed-flow compressor comprising a housing defining an axially and circumferentially extending annular wall defining at an inlet portion thereof an inlet passage of right circular cylindrical shape in transverse section, said annular wall further defining at an outlet portion thereof spaced axially downstream from said inlet portion an outlet passage of right circular conical shape in transverse section which diverges downstream relative to said inlet portion, intermediate of said inlet portion and said outlet portion said annular wall transitioning from said right circular cylindrical shape to said right circular conical shape to define an intermediate passage; and an axially extending rotor journaled for rotation about said axis within said inlet passage, said intermediate passage, and said outlet passage; said rotor including a substantially cone-shaped hub portion and a plurality of axially and circumferentially extending vanes extending substantially radially outwardly toward but short of said annular wall to closely conform thereto at respective axial locations throughout said inlet portion, said intermediate portion and said outlet portion.

Still further, the present invention presents a transonic mixed flow compressor as set out immediately above and wherein said rotor and said housing define cooperating means for receiving at said inlet passage a flow of elastic fluid having a first relative velocity vector sum of tangential and meridional velocities of at least Mach 1.2 with respect to a selected reference, and for diffusing said received fluid flow to a second subsonic relative velocity less than said first relative velocity while maintaining radially outer local relative velocity vectors within 10° of said first relative velocity vector.

According to another aspect of the present invention, a transonic mixed flow compressor is presented comprising a housing defining an inlet portion, an outlet portion, and an axially extending flow path extending therebetween for flow of said elastic fluid; a rotor journaled in said flow path for rotation about said axis and having a respective inlet end and outlet end, said housing and rotor defining cooperating means for defining an annular stream tube extending axially from said inlet toward said outlet in said flow path and diverging downstream radially outwardly to define at a radially outer boundary thereof upstream of said rotor outlet end substantially a right circular conical section.

A method of compressing elastic fluid is also encompassed by the present invention comprising the steps of forming a rotational annulus of axially flowing fluid having an inner diameter, an outer diameter, and a first relative velocity vector sum of meridional and tangential velocities of less than Mach 1; diffusing said flowing fluid to a second relative velocity less than said first relative velocity while increasing progressively downstream said outer diameter and increasing the radially outward component of said meridional velocity; holding said increase of said outer diameter to a constant axial rate while further diffusing said flowing fluid to a third relative velocity less than that of said second relative velocity while decreasing the radially outward component of said meridional velocity to a value less than that of said second relative velocity.

This invention also presents a method of compressing an elastic fluid according to another aspect thereof comprising the steps of forming a tubular stream of said fluid having a radially inner diameter, a radially outer diameter, and a first relative velocity vector sum of meridional and tangential velocities of at least Mach 1.2 at said radially outer diameter; diffusing said fluid to a second supersonic relative velocity less than said first relative velocity while limiting deviation of radially outer local relative velocity vectors to no more than 10° with respect to said first relative velocity vector; passing said fluid through a normal shock to a third relative velocity of less than Mach 1; and further diffusing said fluid stream while increasing downstream both the radially inner and radially outer diameters thereof to impart a significant radially outward component of meridional velocity thereto.

This invention also presents a jet propulsion engine incorporating compressor method and apparatus in accordance with the above. In accordance with the above, it will be seen upon further consideration that the present invention substantially satisfies each of the objectives enumerated therefor hereinabove, and by so doing provides the highly desirable advantages resulting therefrom. Additionally, the applicants have found the present compressor, because of its diffuser structure presenting a diffuser flow path defined between coannular right circular cylindrical wall sections, affords a structure of greater strength for a particular weight than either conventional centrifugal or mixed-flow diffuser structures.

BRIEF DESCRIPTION OF THE DRAWING FIGURES

FIG. 1 schematically depicts a longitudinal partially cross sectional view through a jet propulsion turbofan engine according to the invention;

DETAILED DESCRIPTION OF THE PREFERRED EMBODIMENT

Figure 1:
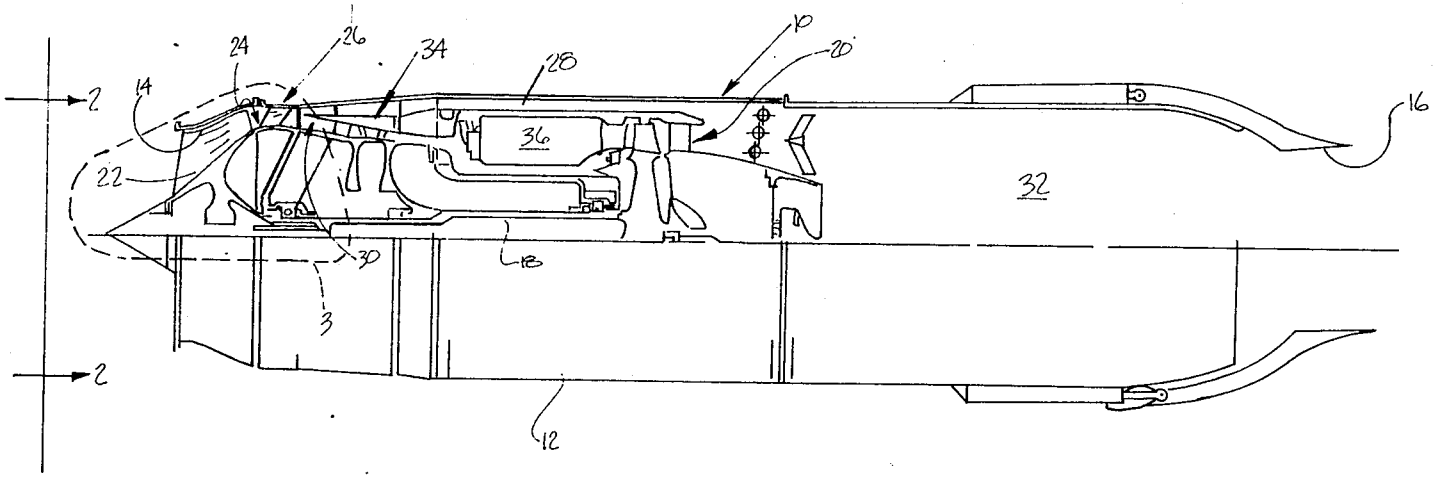

FIG. 1 schematically depicts a turbofan jet propulsion engine 10 which includes an elongate housing 12. Housing 12 defines an inlet opening 14 through which ambient air is inducted, and an outlet opening 16 through which a jet of heated air and combustion products is expelled to the atmosphere. Journaled within the housing 12 is a shaft 18 which is driven by a turbine section 20 of the engine 10. At its forward end the shaft 18 carries a mixed-flow compressor rotor 22 which draws ambient air through the inlet opening 14 and pressurizes the inducted air for use by the remainder of engine 10. Immediately downstream of the rotor 22, the housing 12 defines an annular flow path 24 wherein is disposed a diffuser structure generally referenced with numeral 26, and which in combination with rotor 22 composes the first compressor stage of the engine 10.

Downstream of the diffuser 26, the flowpath 24 is bifurcated into an outer annular flowpath passage 28, and an inner annular core engine flowpath 30. The flowpath 28 communicates directly downstream with a tailpipe portion 32 of the engine 10; which tailpipe portion communicates with outlet opening 16. Accordingly it will be appreciated that the compressor rotor 22 serves also in the capacity of a fan with respect to the turbofan nature of the engine 10.

The core engine flowpath 30 proceeds downstream through a two-stage axial flow compressor section referenced with numeral 34, the two axially spaced apart blade wheels of which are drivingly carried by shaft 18. Flow path 30 subsequently extends through an annular combustor 36, and through the turbine section 20. Turbine section 20 also communicates with tailpipe portion 32 and with outlet opening 16.

Figure 2:
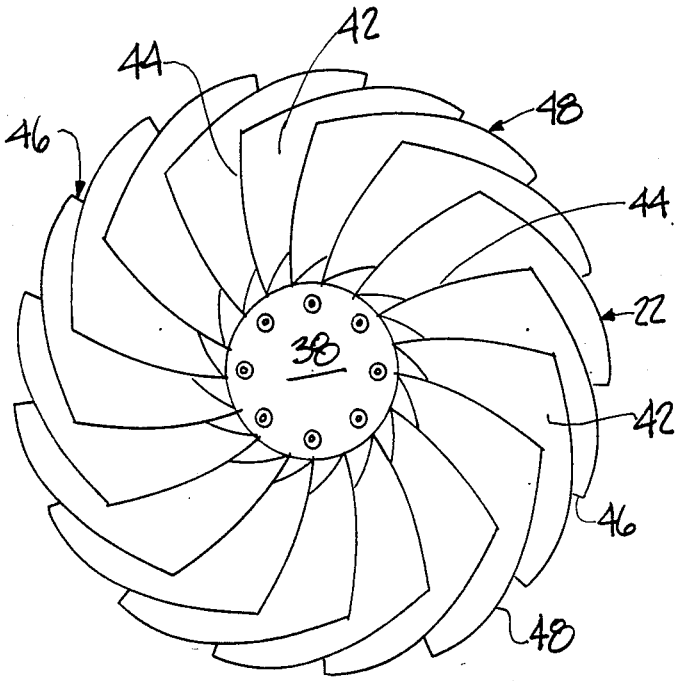
FIG. 2 depicts an enlarged fragmentary axial view taken at line 2—2 of FIG. 1.
Figure 3:
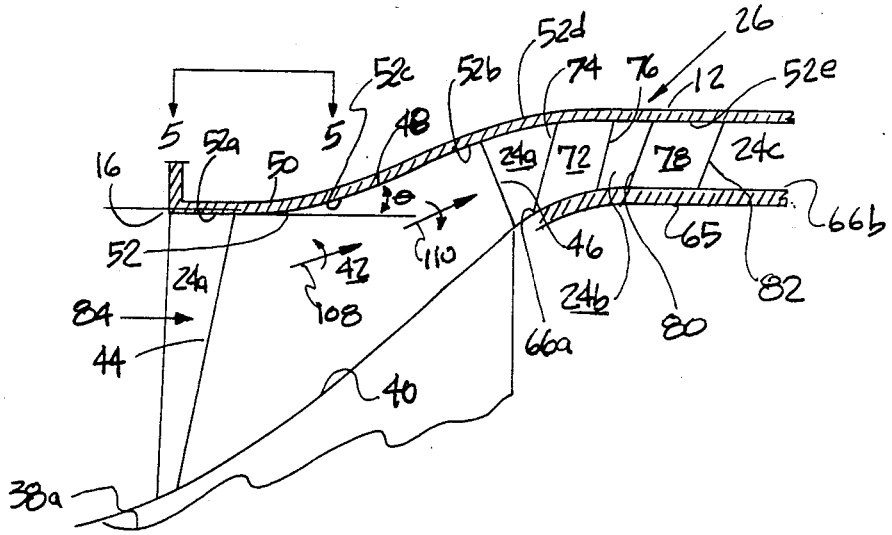
FIG. 3 depicts an enlarged fragmentary view of an encircled portion of FIG. 1, partially in cross section and having portions of the structure omitted for clarity of illustration.

Turning now to FIGS. 2 and 3, a frontal axial view of the compressor rotor 22 is presented along with a fragmentary longitudinal view of compressor rotor 22 and diffuser 26. FIG. 2 illustrates that compressor rotor 22 includes a hub portion 38, which reference to FIGS. 1 and 3 will show to define an outer surface 40 of elongate conical shape. Disposed upon the hub 38 and extending radially outwardly thereon is a plurality of axially and circumferentially extending blades 42. According to the preferred embodiment of the invention as depicted, the blades 42 number 17 and are equiangularly circumferentially spaced apart. Each blade 42 defines a radially extending leading edge 44, a radially extending trailing edge 46, and a radially outer axially and radially extending tip edge 48.

With more particular attention to FIG. 3, it will be seen that the blades 42 extend radially outwardly toward a wall portion 50 of housing 12 to terminate in the radially outer tip edges 48 which are spaced slightly radially inwardly of and in shape matching conforming relationship with a radially inner surface 52 defined by wall portion 50. The wall portion 50 extends continuously axially and circumferentially from inlet opening 16 downstream past compressor rotor 22, flow path 24, and diffuser section 26. Beginning at inlet opening 16 and continuing downstream (rightwardly, viewing FIG. 3) a selected distance therefrom the wall portion 50 defines a radially inner surface subsection **52*a* thereof which defines a right circular cylindrical surface. The right circular cylindrical surface portion 52*a* of wall 50 extends downstream beyond the leading edges 44 of blades 42**.

On the other hand, the wall portion 50 adjacent the trailing edges 46 and extending certain distances both upstream and downstream of the virtual intersection thereof with wall surface 52 (leftwardly, and rightwardly, respectively viewing FIGS. 3 and 4) defines a radially inner surface subsection **52*b* thereof which defines a truncated right circular conical surface. Intermediate of the right circular cylindrical subsection 52*a* of wall 50 and the right circular conical subsection 52*b* thereof, the wall portion 50 defines an axially curvilinear radially inner transition surface subsection 52*c* which is radially inwardly convex. In other words, intermediate of the leading edges 44 and trailing edges 46 of blades 42, the wall 50 defines a subsection 52*c* which is an axially curvilinear transition surface of revolution, and which avoids a defined cusp between the cylindrical and conical subsections 52*a*, 52*b* thereof. Importantly, the curvilinear transition subsection 52*c* does not extend to the trailing edges 46, and in fact joins subsection 52*b*** some distance upstream of these trailing edges.

Figure 4:
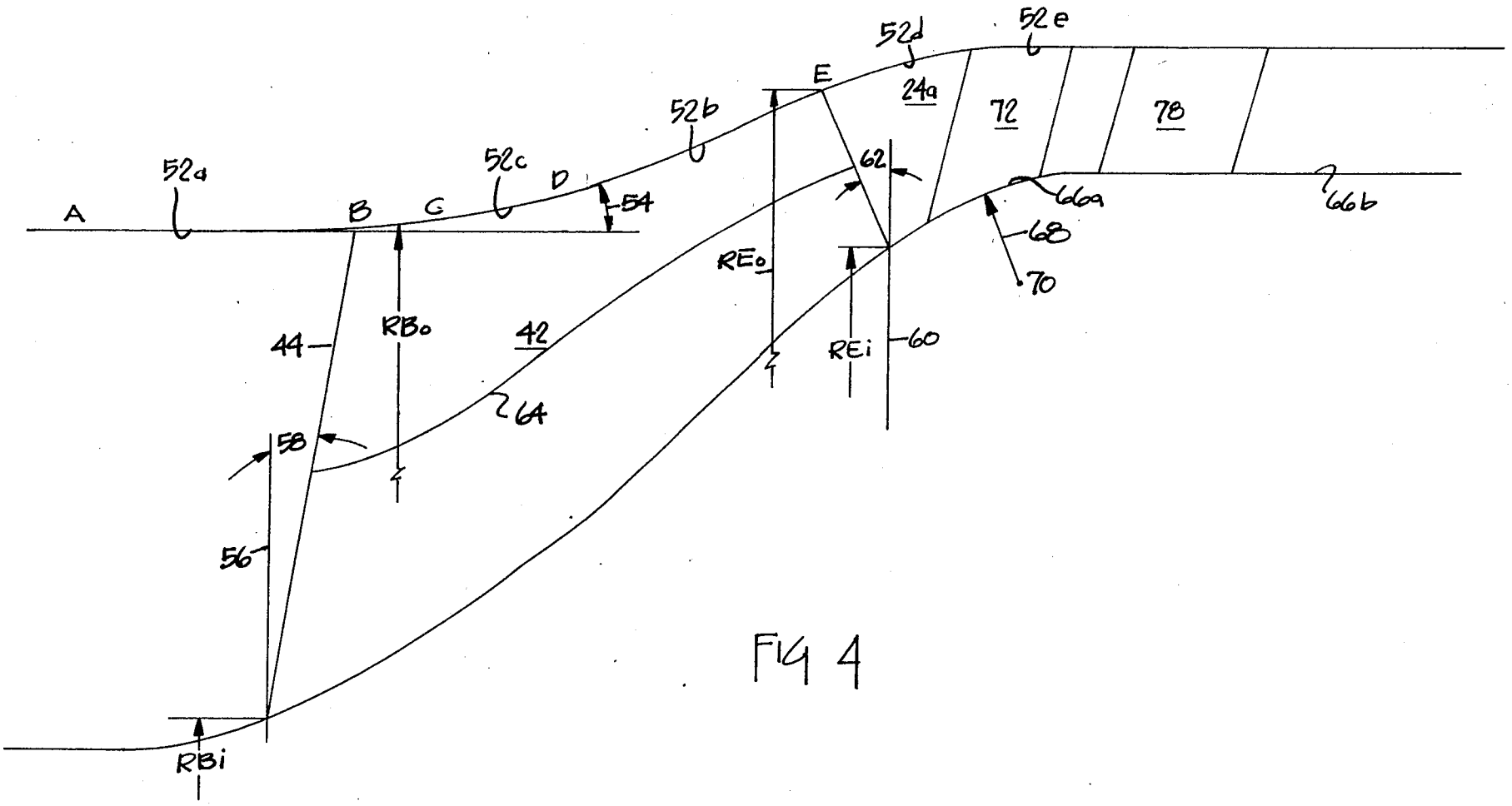
FIG. 4 is similar to FIG. 3, with details of construction omitted to more clearly present geometric aspects of the invention.

More particularly with reference to FIGS. 3 and 4, upstream of the virtual intersection of leading edges 44 with wall 50 (FIG. 4, point B) and extending downstream thereto, the right circular cylindrical surface **52*a* has a axial dimension of from about 10% to about 20% of the meridional dimension of blades 42 at tip edges 48 (FIG. 4, A-B dimension). Similarly, extending downstream from the the virtual intersection of leading edges 44 with wall 50 (FIG. 4, point B), the right circular cylindrical surface 52*a* has an axial dimension of from about 10% to about 30% of the meridional dimension of blades 42 at tip edges 48 (FIG. 4**, B-C dimension).

Adjacent the virtual intersection of trailing edges 46 with wall 50 (FIG. 4, point E), the right conical surface portion **52*b* extends both upstream and downstream. The downstream meridional extension of surface 52*b* is from about 5% to about 15% of the meridional length of blades 42 at tip edges 48. The upstream meridional extension of surface 52*b* from point E is from about 10% to about 30% of the meridional dimension of blades 42 at edges 48 (FIG. 4, D-E dimension). Consequently the transition surface subsection 52*c* defines from about 40% to about 80% of the meridional dimension of the blades 42 at edges 48**.

Viewing FIG. 4 in particular, it will be seen that in axial cross section the flow path coextensive with rotor 22 is radially outwardly bounded by surface **52*a* and 52*b* defining two relatively augulated axially extending straight line segments. the straight line segments of surfaces 52*a* and 52*b* are joined by a continuous, smooth, nonlinear curved surface section 52*c* tangent with both of the straight line surface sections. Preferably, the surfaces 52*a* and 52*b* define an acute angle referenced with numeral 54 of about 22° with respect to one another. However, the angle 54** may be from about 5° to about 45°.

Also viewing FIGS. 3 and 4, it will be seen that the leading edges 44 of the blades 42 are swept downstream radially outwardly with respect to a radially extending line 56 perpendicular to the rotational axis of rotor 22. Preferably, the leading edges 44 define an acute angle referenced with numeral 58 of about 7° . However, the angle 58 may be from about 0° to about 15°. Similarly, the trailing edges 46 are swept upstream radially outwardly with respect to a radially extending line 60 perpendicular to the rotational axis of rotor 22. Preferably, the trailing edges 46 define an acute angle referenced with numerical 62 of about 23°. The angle 62 may, however, be from 0° to about 35°.

Further, with respect to the hub 38 and blades 42 thereon, viewing FIG. 4 will show that a radius dimension RBi is defined at the intersection of leading edge 44 with the outer surface 40 of hub 38. Similarly, at the intersection of trailing edge 46 with surface 40 a radius dimension REi is defined. According to the invention, the ratio of REi to RBi is about 2.75. However this ratio may permissibly vary between about 1.5 and 3.5.

Importantly, the applicants have discovered that in combination with the other salient features herein described, a relatively small ratio of outer radius change of the rotor 22 from leading edge to trailing edge of blades 42 may be employed. In other words, at the virtual intersection of leading edge 44 with surface 52 a radius dimension RBo is defined. At the virtual intersection of trailing edge 46 with surface 52 a radius dimension REo is similarly defined. the ratio of REo to RBo is preferably 1.17. This ratio may however vary from about 1.05 to about 1.76 according to the invention. As will be seen, this relatively low ratio of radius increase from inlet to outlet of the rotor 22 contributes to a relatively small overall diameter for a compressor according to the invention in comparison to its inlet diameter.

A further geometric aspect of the rotor 22 which is considered of importance by the applicants is a dimensionless ratio termed Aspect Ratio (AR), defined below $$AR = \frac{\text{Inlet blade height} + \text{outlet blade height}}{\text{average meridional blade length}}$$

$$= \frac{(RBo - RBi) + (REo - REi)}{\text{average meridional blade length}}$$

The average meridional blade length of blades 42 is depicted on FIG. 4 as line 64, which is generated by those points on the blade lying radially midway between surface 40 and tip edge 48. Preferably, the ration AR is 1.12. This ratio may, however, vary between about 0.75 and 1.30.

Downstream of the trailing edges 46, the housing 12 defines annular fluid flow path 24 by the cooperation of radially outer wall 50 with an annular radially inner wall 65 which is spaced radially inwardly of wall 50 and defines a radially outwardly disposed surface portion 66*a*. Viewing FIG. 4 once again, it will be seen that the surface 66*a* is a curvilinear surface of revolution having a radius referenced with numerical 68 originating from a center point 70. The radius 68 is related to the height of the blades 42 at the trailing edge 46. That is, the radial distance along the trailing edge 46 from its intersection with surface 40 of hub 38 to its virtual intersection with surface 52 is considered the blade height at the trailing edges of blades 46. The ratio of radius 68 to blade height at trailing edge 46 is preferably 2.0. However, this ration may vary from about 1.0 to about 4.0.

Immediately downstream of the trailing edges 46, the flow path 24 is circumferentially continuous and radially open between walls 50 and 65. The radially outer wall 50 defines a surface portion 52*d* which is a curvilinear surface of revolution tangent at it upstream end with the right circular conical surface portion 52*c*. The radius of wall surface 52*d* is matched to that of surface portion 66*a* so that a flow path portion 24*a* is defined which is of substantially constant area despite the radius change in the flow path with respect to the rotational axis of rotor 22. At its downstream end, the surface portion 52*d* is also tangent with a right circular cylindrical surface portion 52*e* defined by wall 50 (viewing FIG. 4). Similarly the wall 65 defines a radially outwardly disposed right circular cylindrical surface portion 66*b* which at its upstream end is tangent with surface portion 66*a* of wall 65.

Viewing FIGS. 3 and 4, it will be seen that an annular array of radially extending and circumferentially spaced apart diffuser vanes 72 extend between the walls 50 and 65 from surface portion's 52*e* to 66*a* thereof, respectively. The vanes 72 each define a leading edge 74, and a trailing edge 76 spaced downstream thereof. While it will be noted that at their radially inner ends, the vanes 72 are relatively close to the trailing edge 46 of compressor blades 42 and intersect the curvilinear surface portion 66*a*, the radially outer ends of the vanes 72 intersect with cylindrical surface portion 52*e*. That is, the diffuser vanes are swept downstream radially outwardly to intersect with the radially outer wall 50 at cylindrical portion 52*e* thereof. Importantly, the leading edge 74 of vanes 72 intersects with wall 50 downstream of the curvilinear surface portion 52*d*. That is, the vanes 74 at their radially outer ends intersect with the right circular cylindrical portion of wall 50 at surface 52*e*. It will be noted that the vanes 72 are swept downstream radially outwardly with respect to a radial perpendicular from the rotational axis of rotor 22. The physical sweep angle is in the range from zero degrees to twenty-five degrees. However, vanes 72 are swept to an even greater aerodynamic degree with respect to air flow from rotor 22. Such is the case because of the combination of axial and radially outward velocity components of this air flow, as will be more fully explained hereinafter.

Downstream of the trailing edges 76 of diffuser vanes 72 the flow path 24 is once again circumferentially continuous to define a vane-wake dissipation area 24*b*. Recalling that the surfaces 52*e* and 66*b* are right circular cylindrical surface section's it will be appreciated that the flow path portion 24*b* is of constant cross sectional flow area. As a result, substantially no flow diffusion occurs within portion 24*b*.

Downstream of the diffuser vanes 72, and spaced axially apart therefrom by approximately one-half a chord dimension of the later, diffuser 26 also includes a second annular array of radially extending and circumferentially spaced apart diffuser vanes 78. The diffuser vanes 78 include leading edges 80 and trailing edges 82 which are swept with respect to a radial perpendicular from the rotational axis of rotor 22. As will be more fully appreciated hereafter, the geometric sweep of the vanes 72 closely approximates their aerodynamic sweep angle because the air flow traversing these diffuser vanes has little or no radial velocity component.

Having observed the structure of the compressor stage composed of compressor rotor 22, walls 50 and 65 of housing 12, and diffuser 26 disposed in flow path 24, attention may now be directed to its operation according to aerodynamic theory. During operation of the engine 10, the turbine section 20 drives shaft 18 at a high speed of rotation. The shaft 18 rotational drives compressor rotor 22. Viewing FIGS. 3 and 4, it will be observed that the wall 50 defining surface portion 52*a* of housing 12 cooperates with an axially extending conical nose portion 38*a* of hub 38 to define an axially extending annular passage which is referenced with numeral 24'. In response to rotation of rotor 22, ambient air is drawn through passage 24', as is represented by arrow 84. Consequently, it will be seen that the passage 24' defines an axially extending annular flow stream of axially flowing air 84.

Figure 5:
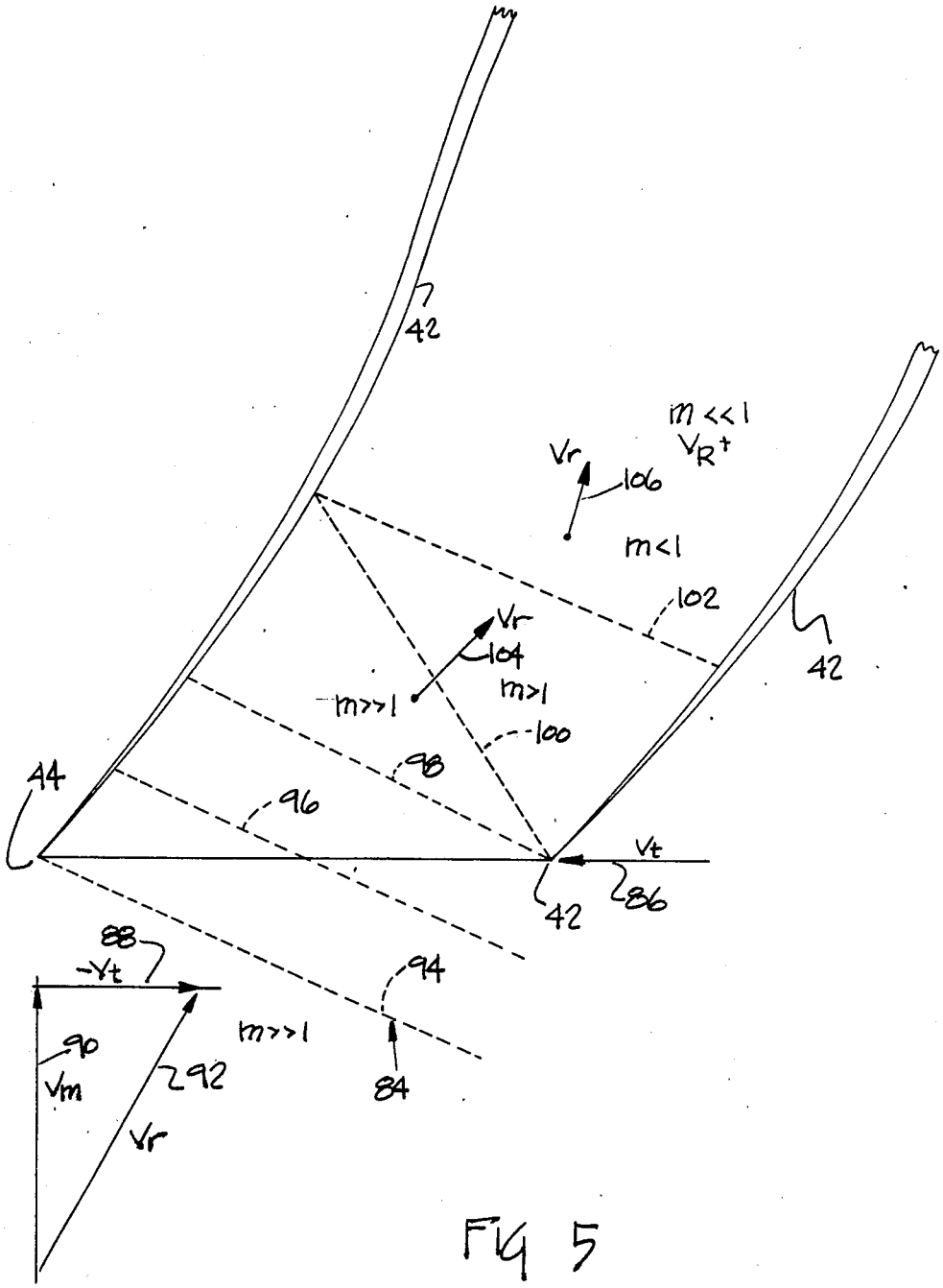
FIG. 5 depicts a fragmentary view taken parallel with line 5—5 at the radially outer tip of the compressor rotor of FIG. 3 with the perspective being radially inward.

Upon encountering the leading edges 44 of blades 42, the annular flow stream of air 84 is subdivided into substreams which are circumferentially spaced apart by the blades 42, viewing FIG. 5. As FIG. 5 depicts, adjacent the tip edge 48 the leading edges 44 have a tangential velocity vector (Vt) referenced with numeral 86. Consequently air flow 84 approaching the blades 42 has a negative relative tangential velocity vector of −Vt, which is referenced by numeral 88. The air flow 84 adjacent the tip edges 48 also has a meridional component of relative velocity represented by vector (Vm) and referenced with numeral 90. Meridional velocity as used herein is the vector sum of axial and radial airflow velocity components. Consequently, air flow 84 has a relative velocity vector sum of Vt and Vm which is represented by vector Vr, and referenced with number 92. Meridional relative velocity vector Vm includes also any radial relative velocity component (VR) between blades 42 and air flow 84. However, adjacent the intersection of tip edges 48 and leading edges 44 the outward radial velocity of air flow 84 must be zero, or substantially zero because wall surface 52*a* is of right circular cylindrical shape. Relative velocity vector 92 (Vr) has a magnitude of at least Mach 1.2, and preferably in the range of Mach 1.3 to 1.5, or higher.

As a consequence of the high relative velocity of vector Vr, the leading edge 44 of each blade 42 is believed to originate a Mach wave which is referenced with numeral 94, viewing FIG. 4. Also, according to the invention the surface of blades 42 extending downstream of leading edge 44 and facing in a tangential direction opposite to the rotational direction of rotor 22 is shaped according to known aerodynamic principles to originate multiple additional Mach waves, which as depicted are two in number and are referenced with numerals 96,98. It will be understood that the number of additional Mach waves may be other than two as depicted. However, it is an important aspect of the invention that at the selected operating condition for the compressor stage, one of the Mach waves (wave 98 as depicted) encounters the next circumferentially adjacent blade 42 opposite to the direction of rotation of rotor 22 at or downstream of the leading edge 44 thereof. As a result, the wave 98 becomes a captured Mach wave. At or adjacent the leading edge 44 which has captured the Mach wave 98, an oblique shock wave 100 is believed to originate and to extend toward the next circumferentially adjacent blade 42 in the direction of rotation of rotor 22. Subsequently, a normal shock 102 is believed to be formed downstream of oblique shock 100. Each of the Mach waves 94, 96, 98, oblique shock 100 and normal shock 102 is believed to effect a diffusion or slowing of the flow of air 84 relative to blades 42, and a concomitant increase of total pressure of the airflow. As an aid to the reader, notations have been placed upon FIG. 5 which are generally indicative of the relative velocity of the airflow field at the location of the particular notation.

Recapping the foregoing, the airflow 84 approaches rotor 22 as an axially flowing annular stream tube having a relative velocity of at least Mach 1.2 (FIG. 5, $M>>1$) represented by vector 92 (Vr). Upon encountering the blades 42, the airflow is weakly diffused through successive plural Mach waves 94–98, the last of which is a captured Mach wave preceding a stronger oblique shock 100. Upstream of the oblique shock 100, the airflow has a relative velocity vector 104 which is supersonic (FIG. 5, $M>>1$), but lesser in magnitude than velocity vector 92. Downstream of the oblique shock 100, the airflow has a relative velocity greater than Mach 1, (FIG. 5, $M<1$), but less than the velocity upstream of the shock 100. Immediately downstream of the normal shock 102, the airflow has a relative velocity less than Mach 1 (FIG. 5, $M<1$), and a direction substantially perpendicular to the shock 102, as is represented by vector 106.

Importantly, the vector 106 has a direction which deviates by no more than 10° with respect to vector 92. Large turning angles in the presence of diffusion of supersonic flow are extremely difficult to obtain without extremely high aerodynamic losses. The Applicants have discovered that a turning of 10° or less will allow diffusion of supersonic airflow preceding a normal shock with high efficiency. Such a limited supersonic flow turning in the range of about 10° or less enhances, the applicants believe, the probability of achieving a shock structure having only a single normal shock, and monotonically decelerating flow to a velocity of less than Mach 1.

Returning once again to FIG. 3, it will be seen that the hub 38 increases in radial dimension somewhat uniformly with axial dimension. However, the tangential velocity of points on the blades 42 increases with radius and is a product of rotor angular velocity and radius. Consequently, the relative velocity adjacent the hub 38 is much less than the level of Mach 1.2, or higher, which is experienced at the tip edges 48 adjacent leading edges 44. As a result, flow turning adjacent the intersections of leading edges 44 with the hub 38 may permissibly exceed 10°.

Nevertheless, adjacent the intersection of tip edges 48 and leading edge 44 where the relative velocity is Mach 1.2 or higher the flow turning cannot, the applicants believe, be allowed to exceed 10° without incurring undesirable aerodynamic losses. It follows that the cylindrical wall subsection 52*a* is of importance in the present invention because such subsection limits the radial component of local meridional velocity to substantially zero. Accordingly, the tangential velocity component Vt and rotational speed of rotor 22 is easily determined so that Vr at the intersection of leading edges 44 with tip edges 48 is Mach 1.2 or higher. While the cylindrical wall subsection 52*a* is considered an important and desirable feature of a transonic mixed flow compressor according to the invention, deviation from the cylindrical shape is permissible so long as the resulting radial component of Vm (vector 90) is taken into consideration.

Further considering FIG. 3, it will be recalled that wall subsection 52*c* curves outwardly to increase in radial dimension with downstream axial dimension. This outward flare of the wall subsection 52*c* lending with the upstream end of the right circular conical wall subsection 52*b* is accompanied by an increase of the radially outward component (VR) of relative meridional velocity and further diffusion to a relative velocity considerably below Mach 1. Such increase of the radially outward component of meridional velocity with increasing radius is expected and is the advantageous effect of centrifugal compressors which conventional mixed flow compressors have attempted to utilize. However, such radially outward velocity component continues to increase with radial dimension as air flows along the rotor in conventional centrifugal and mixed-flow compressors to such an extent that conventional downstream flow turning losses, diffuser structure difficulties, and excessive overall outer diameter limitations have heretofore persisted.

Surprisingly, the applicants have discovered that in a compressor according to the invention even though the annular flow stream is diverging downstream and increasing in radial dimension, if the radially outer flow stream boundary is limited to increase of radial dimension as a substantially constant linear function of axial dimension, then the growth of the radially outward velocity component will cease or reverse itself within the axial confines of the compressor rotor. In other words, the meridional velocity vector (summation of axial and radial velocity components) which begins to swing radially outwardly with increasing radial dimension of the annular flow stream downstream of wall subsection 52a (arrow 108, viewing FIG. 3) actually stops such outward swing and begins to swing back toward the true axial direction (arrow 110, viewing FIG. 3) upstream of the trailing edges 46 of rotor 22 despite the increasing radial dimension of the annular flow stream.

In view of the above, the importance of the right circular conical wall subsection 52b is easily appreciated. This wall subsection 52b forms a critically important radially outer boundary of the annular flow stream traversing the compressor rotor 22. Preferably, the right circular conical subsection 52b extends upstream of trailing edges 46 about 10% to 30% of the meridional dimension of the tip edges 48. However, a relatively shorter segment of conical wall section may be employed within the scope of the present invention provided that the conic section extends upstream of the trailing edges of the rotor blades sufficiently to limit the growth of, hold constant, or effect a decrease of the radially outward component of meridional airflow velocity.

The decrease of radially outward airflow velocity on rotor 22 described above makes possible the use of a diffuser structure 26 which is believed to be more akin to axial-flow technology and quite different than any conventional mixed-flow compressor stage. Considering diffuser 26, the wall 50 radially outwardly of flowpath subsection 24a is axially curvilinear to effect a limited turning of the air flow from rotor 22 which has tangential, axial and radially outward absolute velocity components. Turning of the airflow in response to curvature of wall 50 effects a reduction of the radially outward velocity component. Additionally, the vaneless space 24a is believed to effect an accommodation of local flow aberrations so that the flow is more fully homogenized before encountering diffuser vanes 72.

The diffuser vanes 72 have a leading edge 74 which is apparently swept in a physical sense, i.e. swept relative to a perpendicular from the rotational axis of rotor 22. The vanes 72 are swept with their radially outer leading edge farther downstream than their radially inner leading edge. What is not immediately apparent from viewing FIG. 3 is that the vanes 72 have an aerodynamic sweep angle exceeding their physical sweep angle. Such is the case because the air flow in diffuser space 24a has a substantial radially outward velocity component so that the airflow may be represented by a radially outwardly angulated vector like arrows 108 and 110, viewing FIG. 3. It will be appreciated that because the air flow is angled radially outwardly, the aerodynamic sweep angle of vanes 72 exceeds their physical sweep angle according to the angulation of the air flow in space 24a relative to the axis of rotor 22.

An additional aspect of the diffuser vanes 72 which is not observable from structure alone is that while the vanes extend substantially radially between the walls 50 and 65, they are leaned tangentially in an aerodynamic sense. In order to understand this aerodynamic lean it must be recalled that the airflow in diffuser space 24a has a significant tangential component of velocity. Further, this tangential velocity component increases radially outwardly from the wall 65 toward the wall 50. Consequently, even though the vanes 72 extend substantially radially between walls 50,65, they are aerodynamically leaned radially outwardly in a direction opposite to the direction of rotation of rotor 22, and opposite to the direction of tangential velocity of airflow in diffuser space 24a. In other words, the radially outer end of each vane 72 is aerodynamically displaced tangentially relative to the radially inner end of the vane in a direction opposite to the direction of rotation of the rotor 22. Stated still differently, an air flow element exiting rotor 22 near the tip edge 48 will, because of its higher tangential and axial velocity, encounter the leading edges 74 of diffuser vanes 72 in a shorter time than an airflow element exiting the rotor near the hub 38. Consequently, the diffuser vanes 72 are effective not only to reduce the tangential component of airflow velocity from chamber 24a while diffusing the airflow to a lower absolute velocity and higher static pressure, but also to reduce the remaining radially outward component of airflow velocity to substantially zero.

Downstream of the array of diffuser vanes 72, the diffuser section 26 includes another vaneless space 24b which extends axially and is open radially between the walls 50 and 65. Similarly to the vaneless space 24a, the space 24b is believed to allow "adjustment" or accommodation of local flow aberrations so that the airflow is more fully homogenized before encountering the diffuser vanes 78. The diffuser vanes 78 extend radially between the walls 50, 65. Vanes 78 diffuse the airflow from diffuser space 24b to a lower absolute velocity and increased static pressure while reducing the tangential velocity component thereof to substantially zero. Further, the radial component of airflow velocity which was reduced to substantially zero by the diffuser vanes 72 is maintained at the substantially zero level by vanes 78. Consequently, the diffuser vanes 78 deliver to flow path subsection 24c an airflow having substantially pure axial flow.

In order to complete this description of the inventive compressor stage it must be noted that the shape of blades 42 on rotor 22 is determined in accordance with conventional airflow streamline predictive techniques. In other words, with a view to the inventive compressor methods herein described, the airflow streamline directions at points in the annular flow stream are predicated based upon known aerodynamic principles. Appropriate blade surface segments are then established based upon accepted blade pressure loading, airflow velocity, and diffusion parameters. The resulting blade surface segments are stacked radially outwardly from the hub 38 and blended to determine the resulting shape of the blades 42. Accordingly, the precise shape, thickness, curvature and other characteristics of the blades 42 will vary dependent upon the design objectives of each particular compressor stage.

An actual reduction to practice of the present invention has been made substantially according to the preferred embodiment herein described. This actual reduction of the invention included a rotor having 17 blades, an overall axial dimension of 4 inches excluding the rotor nose portion, a hub/tip diameter ratio of 0.35 at the blade leading edges, and an operating speed of 33,216 R.P.M. With a compressor stage static pressure ratio of 3.0 and a corrected through flow of 20 pounds of air per second the rotor adiabatic efficiency was 89.5%, and the stage efficiency was 85.3%, with an airflow velocity of Mach 0.54 downstream of the stator vanes 78. The diffuser vanes 72 and 78 each numbered 44 vanes equiangularly disposed downstream of the rotor 22. The overall compressor stage length was 10.6 inches with a rotor outer diameter of 12.8 inches. As will be appreciated viewing FIG. 3, the overall outer diameter of the compressor stage, at about 105% of the rotor outer diameter, was only slightly larger than the outer diameter of the compressor rotor.

Accordingly it will be seen in view of the above that the present invention provides a transonic mixed-flow compressor which achieves a static pressure ratio favorably comparable to a centrifugal compressor while achieving an efficiency approaching the best contemporary axial-flow compressor technology. Testing has verified the tolerance to inlet airflow distortion of a compressor according to the invention. Resistance to damage from ingestion of foreign objects is believed to be substantially the same for a compressor according to the invention as for a centrifugal compressor. Further, it is believed that a compressor according to the present invention will have a cost comparable to contemporary centrifugal compressors. Finally, the outer diameter or envelope of a compressor stage according to the present invention is very favorably comparable to conventional axial flow compressors.

The present invention has been depicted described and defined with reference to a particular preferred embodiment thereof. Reference has also been made herein to an actual reduction to practice of the present invention. However, such references do not imply a limitation upon the invention, and no such limitation is to be inferred because of such references. The present invention is intended to be limited only by the spirit and scope of the appended claims which also provide a definition of the invention.

What is claimed is:

1. The method of pressurizing elastic fluid to increase the pressure level thereof from a first pressure level to a higher second pressure level; said method comprising the steps of:

(a) forming a first tubular stream of said fluid at said first pressure level and having a longitudinal axis, a first radially inner diameter, a first radially outer diameter, and a first relative velocity vector sum of meridional velocity and tangential velocity of at least Mach 1.2 with respect to a selected reference at said radially outer diameter;

(b) subdividing said flow stream into a plurality of axially extending and circumferentially spaced apart substreams;

(c) diffusing each of said substreams to a second supersonic relative velocity less than said first relative velocity while limiting deviation of radially outer local relative velocity vectors to no more than 10° with respect to said first relative velocity vector;

(d) passing each of said substreams through a respective normal shock to a third relative velocity of less than Mach 1;

(e) increasing progressively downstream from said normal shock both the radially inner and radially outer diameters of said flow stream as an aggregate of said substreams respectively above said first diameters while further diffusing the relative velocity of each of said substreams to a fourth subsonic relative velocity less than said third relative velocity and increasing the radially outward component of local meridional velocity;

(f) limiting the downstream increase of said outer aggregate diameter to a constant axial rate while decreasing said radially outward component of local meridional velocity and effecting further diffusion of each substream to a fifth subsonic relative velocity less than said fourth relative velocity; and (g) reuniting said plurality of substreams into a respective second tubular stream of said fluid having a sixth subsonic absolute velocity vector sum of meridional and tangential velocities.

2. The method of claim 1 wherein said method further includes the steps of:

(h) subdividing said second tubular stream into a second plurality of axially extending and circumferentially spaced apart substreams each having substantially said sixth absolute velocity vector sum of tangential and meridional velocities, the latter of which includes a radially outward component of seventh value;

(i) diffusing each of said second substreams to an eight absolute velocity vector sum of tangential and meridional velocities having a tangential component less than that of said sixth vector sum and a radial component of substantially zero, (j) reuniting said second plurality of substreams into a respective third tubular stream of said fluid having said eight subsonic absolute velocity vector sum of meridional and tangential velocities.

3. The method of claim 2 wherein said method further includes the steps of:

(k) subdividing said third tubular stream into a third plurality of axially extending and circumferentially spaced apart substreams each having substantially said eight absolute velocity vector sum of meridional and tangential velocities;

(l) diffusing each of said third substreams to a ninth absolute velocity vector sum of meridional and tangential velocities having a tangential component of substantially zero while maintaining a radial velocity component of substantially zero;

(m) reuniting said third plurality of substreams into a respective fourth tubular stream of said fluid having said ninth subsonic absolute velocity vector sum of meridional and tangential velocities having both radial and tangential components of substantially zero (substantially pure axial flow).

4. The method of pressurizing an elastic fluid comprising the steps of:

(a) forming a tubular stream of said fluid having a radially inner diameter, a radially outer diameter, and a first relative velocity vector sum of meridional and tangential velocities of at least Mach 1.2 at said radially outer diameter;

(b) diffusing said fluid to a second supersonic relative velocity less than said first relative velocity while limiting deviation of radially outer local relative velocity vectors to no more than 10° with respect to said first relative velocity vector;

(c) passing said fluid through a normal shock to a third relative velocity of less than Mach 1; and (d) further diffusing said fluid stream while increasing downstream both the radially inner and radially outer diameters thereof to impart a significant radially outward component of meridional velocity thereto.

5. The method of pressurizing an elastic fluid comprising the steps of:

(a) forming a rotational annulus of axially flowing fluid having an inner diameter, an outer diameter, and a first relative velocity vector sum of meridional and tangential velocities of less than Mach 1;

(b) diffusing said flowing fluid to a second relative velocity less than said first relative velocity while increasing progressively downstream said outer diameter and increasing the radially outward component of said meridional velocity;

(c) holding said increase of said outer diameter to a constant axial rate while further diffusing said flowing fluid to a third relative velocity less than that of said second relative velocity while decreasing the radially outward component of said meridional velocity to a value less than that of said second relative velocity.

6. Compressor apparatus comprising:

a rotor journaled for rotation about an axis, said rotor including a hub portion defining an inlet end and an outlet end with respect to compressible elastic fluid flow therealong, said rotor defining respectively an inlet end outer diameter and an outlet end outer diameter which is larger than said inlet end outer diameter, said hub also defining a curvilinear substantially cone-shaped outer surface extending axially and circumferentially between said inlet end and said outlet end.

a axially extending housing circumscribing said rotor and being spaced radially outwardly of said hub portion outer surface, said housing defining an inlet wall portion axially congruent with said hub portion inlet end and being in transverse section of right circular cylindrical shape, said housing also defining an outlet wall portion axially congruent with said hub portion outlet end and being in transverse section of right circular conical shape, an intermediate wall portion extending between said inlet wall portion and said outlet wall portion and smoothly transitioning downstream from said inlet wall portion right circular cylindrical shape to said outlet wall portion right circular conical shape.

7. The invention of claim 6 further including axially extending blade means carried by said hub portion and extending radially outwardly closely to but short of said housing.

8. The invention of claim 7 wherein said blade means define means for cooperating with said hub portion and with said housing for defining a flow path for receiving a flow stream of compressible fluid having a first vector sum of meridional velocity and tangential relative velocity of at least Mach 1.2 with respect to a selected reference adjacent said housing inlet wall portion, and for diffusing said flow stream to a second supersonic relative velocity less than said first relative velocity while limiting deviation of radially outer local relative velocity vectors to no more than 10° with respect to said first relative velocity vector.

9. The invention of claim 7 wherein said blade means extend circumferentially from said inlet end to said outlet end in a direction opposite to a selected rotational direction for said rotor and further comprise determined compressible fluid stream line shapes stacked substantially radially outwardly from said hub portion outer surface toward said housing.

10. The invention of claim 9 further including annular diffuser means juxtaposed with said rotor at said hub portion outlet end for receiving via said flow path a flow of compressible fluid having a first determined subsonic relative velocity vector sum of tangential and meridional velocity having a respective significant radially outward component and discharging a flow of compressible fluid having a second determined relative velocity vector having radially outward and tangential components of substantially zero (substantially pure axial flow).

11. The invention of claim 10 wherein said diffuser means includes successive downstream first and second axially spaced apart annular arrays of circumferentially spaced apart diffuser vane means.

12. The invention of claim 11 wherein said first diffuser vane means comprises means for receiving via said flow path at said hub portion outlet end said flow of compressible fluid having said first determined relative velocity vector and for diffusing said fluid flow to discharge into an axially extending interdiffuser space a flow of said fluid having a second determined relative velocity vector less than said first relative velocity vector and having a radially outward component of substantially zero.

13. The invention of claim 12 wherein said second diffuser vane means comprises means for receiving from said interdiffuser space said flow of fluid having said second determined relative velocity vector and for diffusing the latter to discharge a flow of said fluid having a third determined relative velocity vector less than said second relative velocity vector and having both tangential and radially outward components of substantially zero.

14. A mixed flow transonic elastic fluid compressor comprising a housing defining an inlet portion, an outlet portion, and an axially extending flow path extending therebetween for flow of said elastic fluid; a rotor journaled in said flow path for rotation about said axis and having a respective inlet end and outlet end, said housing and rotor defining cooperating means for defining an annular stream tube extending axially from said inlet to said outlet in said flow path and diverging downstream radially outwardly to define at a radially outer boundary thereof upstream of said rotor outlet end substantially a right circular conical section.

15. The invention of claim 14 wherein said rotor inlet end and said housing further include second cooperating means for receiving elastic fluid flow at said inlet end of said annular stream tube having a first relative velocity vector sum of meridional and tangential velocity of at least Mach 1.2 at a radially outer reference, and for diffusing said received fluid flow downstream to a second supersonic relative velocity less than said first relative velocity while maintaining radially outer relative velocity vectors within 10° of said first relative velocity vector.

16. The invention of claim 15 wherein said second cooperating means comprise a plurality of circumferentially spaced apart axially and circumferentially extending blades projecting radially outwardly on said rotor in accordance with stream line shapes of a selected compressible fluid traversing said rotor from inlet end to outlet end and stacked substantially radially outwardly on said rotor.

17. Mixed flow transonic compressor apparatus comprising a housing defining an axially and circumferentially extending annular wall defining at an inlet portion thereof an inlet passage of right circular cylindrical shape in transverse section, said annular wall further defining at an outlet portion thereof spaced axially downstream from said inlet portion an outlet passage of right circular conical shape in transverse section which diverges downstream relative to said inlet portion, intermediate of said inlet portion and said outlet portion said annular wall transitioning from said right circular cylindrical shape to said right circular conical shape to define an intermediate passage; and an axially extending rotor journaled for rotation about said axis within said inlet passage, said intermediate passage, and said outlet passage; said rotor including a substantially cone-shaped hub portion and a plurality of axially and circumferentially extending blades extending substantially radially outwardly thereon toward but short of said annular wall to closely conform thereto at respective axial locations throughout said inlet portion, said intermediate portion and said outlet portion.

18. The invention of claim 19 wherein said rotor and said housing define cooperating means for receiving at said inlet passage a flow of elastic fluid having a first relative velocity vector sum of tangential and meridional velocities of at least Mach 1.2 with respect to a selected reference, and for diffusing said received fluid flow to a second supersonic relative velocity less than said first relative velocity while maintaining radially outer local relative velocity vectors within 10° of said first relative velocity vector.

19. The invention of claim 17 wherein each of said plurality of blades defines both a radially extending leading edge, and a radially, axially, and circumferentially extending radially outer tip edge disposed in shape-matching movable relationship with said annular wall at said inlet portion said intermediate portion, and said outlet portion thereof; said tip edges considered in axial and radial aspect defining a tip edge meridional dimension for said blades, said leading edges defining a virtual intersection with said annular wall at said inlet portion thereof.

20. The invention of claim 19 wherein said annular wall inlet portion of right circular cylindrical section extends upstream of said virtual intersection of said leading edges therewith for a first determined dimension.

21. The invention of claim 20 wherein said first determined dimension is from about 10% to about 20% of said tip edge meridional dimension.

22. The invention of claim 11 wherein said annular wall inlet portion of right circular cylindrical section extends downstream of said virtual intersection of said leading edges therewith for a second determined dimension.

23. The invention of claim 22 wherein said second determined dimension is from 10% to 30% of said tip edge meridional dimension.

24. The invention of claim 19 wherein said leading edges are swept downstream radially outwardly with respect to a radially extending line from said axis to define a leading edge sweep angle.

25. The invention of claim 24 wherein said leading edge sweep angle is in the range of substantially 0° to substantially 15°.

26. The invention of claim 25 wherein said leading edge sweep angle is substantially 7°.

27. The invention of claim 19 wherein said plurality of blades each further define a radially extending trailing edge, said trailing edges defining a virtual intersection with said annular wall at said outlet portion thereof.

28. The invention of claim 27 wherein said conical section outlet portion of said annular wall extends upstream of said virtual intersection of said trailing edges therewith for a third determined dimension.

29. The invention of claim 28 wherein said third determined dimension is from about 10% to about 30% of said tip edge meridional dimension.

30. The invention of claim 27 wherein said conical section outlet portion of said annular wall extends downstream of said virtual intersection of said trailing edges therewith for a fourth determined dimension.

31. The invention of claim 30 wherein said fourth determined dimension is from about 5% to about 15% of said tip edge meridional dimension.

32. The invention of claim 27 wherein said trailing edges are swept upstream radially outwardly with respect to a radially extending line from said axis to define a trailing edge sweep angle.

33. The invention claim 32 wherein said trailing edge sweep angle is in the range of substantially 0° to substantially 35°.

34. The invention of claim 33 wherein said trailing edge sweep angle is substantially 23°.

35. The invention of claim 27 wherein said leading edges define a diameter RBi at an intersection thereof with said hub portion and a diameter RBo at the intersection thereof with said tip edges; said trailing edges defining a diameter REi at an intersection thereof with said hub portion and a diameter REo at the intersection thereof with said tip edges.

36. The invention of claim 35 wherein the ratio of REi to RBi is in the range from about 1.5 to about 3.5.

37. The invention of claim 36 wherein the ratio of REi to RBi is substantially 2.75.

38. The invention of claim 35 wherein the ratio of REo to RBo is in the range from about 1.05 to about 1.76.

39. The invention of claim 38 wherein the ratio of REo to RBo is substantially 1.17.

40. The invention of claim 35 wherein each of said blades define a quantity termed, average meridional blade length (AMBL), which is the length in axial and radial aspect of a line along a blade from said leading edge to said trailing edge and defined by points on said blade radially midway between said hub portion and said tip edge, the ratio (AR) of (RBo-RBi)+(REo-REi) to AMBL lying in the range from about 0.75 to about 1.30.

41. The invention of claim 40 wherein the ratio AR is substantially 1.12.

42. The invention of claim 35 wherein said blades define a height dimension at the trailing edge thereof defined as REo-REi, said compressor apparatus further including another axially and circumferentially extending annular wall disposed radially inwardly of said annular wall and immediately downstream of said rotor, said annular wall and said another annular wall being radially spaced apart to define an axially extending annular flow path downstream of said rotor, said inner wall defining a first radially outwardly disposed convex annular surface portion bounding said flow path and being arcuate of radius R in axial section, the ratio of said trailing edge blade height to radius R lying in the range from about 1.0 to about 4.0.

43. The invention of claim 42 wherein the ratio of trailing edge blade height to radius R is substantially 2.0.

44. The invention of claim 42 wherein said annular wall defines a radially inwardly disposed concave annular surface portion bounding said flow path downstream of said right circular conical outlet portion, said concave annular surface portion of said annular wall cooperating with said convex annular surface portion of said another annular wall to define said flow path downstream of said rotor and extending radially outwardly and axially with substantially constant transverse sectional fluid flow area.

45. The invention of claim 44 wherein said annular wall defines a second right circular cylindrical portion radially outwardly bounding said flow path downstream of said concave annular surface portion thereof, a first annular array of plural radially extending diffuser vanes extending between said convex annular surface portion and said annular wall, said diffuser vanes each having a leading edge with respect to fluid flow, and said leading edges of said first array of diffuser vanes intersecting said annular wall downstream of said concave annular surface portion of said annular wall.

46. The invention of claim 45 wherein said leading edges of said first annular array of diffuser vanes are swept downstream radially outwardly with respect to a radial line from said axis.

47. The invention of claim 45 wherein said another annular wall defines a third right circular cylindrical portion spaced radially inwardly of said second right circular cylindrical portion and radially inwardly bounding said flow path downstream of said convex annular surface portion thereof, a second annular array of plural radially extending diffuser vanes extending between said second and said third right circular cylindrical wall portions.

48. The invention of claim 47 wherein said first annular array of plural diffuser vanes each include also a trailing edge spaced axially downstream of said leading edges, said leading edges and said trailing edges cooperating to define a chord dimension for said first annular array of plural diffuser vanes, said second annular array of plural diffuser vanes being spaced axially downstream of said first annular array of plural diffuser vanes by substantially one-half of said chord dimension.

49. The invention of claim 17 wherein said right circular section inlet portion and said right circular conical section outlet portion of said annular wall are in axial section angularly disposed relative to one another so as to define a certain acute angle therebetween.

50. The invention of claim 49 wherein said certain acute angle lies in the range from about 520 to about 45°.

51. The invention of claim 50 wherein said certain acute angle is substantially 22°. .

52. Compressor apparatus for elastic fluid comprising:

a first axially extending radially outer annular wall having first through fifth portions thereof arranged sequentially downstream with respect to a fluid flow through said compressor, said first wall portion defining a compressor inlet and inwardly being of right circular cylindrical shape in transverse section, said second wall portion being radially inwardly convex to transition between said first wall portion and said third wall portion, said third wall portion being inwardly of right circular conical shape and diverging downstream in transverse section, said fourth wall portion being radially inwardly concave to transition between said third wall portion and said fifth wall portion and defining an annular fluid flow path in cooperation with a second radially inner annular wall, said fifth wall portion being inwardly of right circular cylindrical shape in transverse section;

said second radially inner annular wall being disposed downstream of said inlet in substantial radial juxtaposition with said fourth and fifth portions of said radially outer wall to define a rotor chamber in juxtaposition with said first through third wall portions, said second wall having portions thereof designated sixth and seventh in sequential downstream axial arrangement, said sixth wall portion being radially outwardly convex and arcuate in axial section to define a radius R and further cooperating with said fourth wall portion to define said annular flow path, said annular flow path extending axially and radially outwardly and being of substantially constant transverse fluid flow area, said seventh wall portion being outwardly of right circular cylindrical shape in transverse section and cooperating with said fifth wall portion to define a downstream extension of said annular flow path also having a substantially constant transverse fluid flow area;

a rotor member rotationally disposed within said rotor chamber and including a substantially conical hub portion having an inlet end diameter and an outlet end of relatively larger diameter axially adjacent to and substantially matching in diameter with said sixth wall portion, a plurality of circumferentially spaced apart axially, and circumferentially extending compressor blades extending radially outwardly from said hub toward but short of said first annular wall to terminate in radially outer blade tip edges in shape matching movable relation with said first through third wall portions, said plurality of blades each defining a radially extending leading edge defining a virtual intersection with said first wall portion and a radially extending trailing edge defining a virtual intersection with said third wall portion;

a first plurality of circumferentially spaced apart axially extending diffuser vanes extending radially between and intersecting with said fifth and sixth wall portions, each of said first plurality of diffuser vanes defining a leading edge disposed at its radially outer end downstream of said fourth wall portion, said first plurality of diffuser vanes also each having a trailing edge defining a chord dimension therefor;

a second plurality of circumferentially spaced apart axially extending diffuser vanes spaced downstream of said first plurality by substantially one-half said chord dimension and extending radially between said fifth and seventh wall portions.

53. The method of diffusing an annulus of flowing elastic fluid having a first absolute velocity and respective first tangential and radially outward components of velocity, said method comprising the steps of:

(a) subdividing said annulus into a plurality of radially outwardly and axially extending circumferentially spaced apart substreams each having substantially said first tangential and radially outward components of velocity;

(b) diffusing each of said plurality of substreams to a second absolute velocity less than said first absolute velocity and having a respective axial velocity, a respective tangential velocity significantly less than said first tangential velocity, and a respective radially outward velocity component in the range of substantially zero to a negative value;

(c) reuniting said plurality of substreams into a second annulus of flowing fluid having said second absolute velocity, said second axial velocity component, said second tangential component of velocity, and said second radially outward component of velocity;

(d) subdividing said second annulus into a second plurality of axially extending and circumferentially spaced apart substreams each having substantially said second absolute velocity, said second axial velocity component, said second tangential velocity component, and said second radially outward velocity component;

(e) diffusing each of said substreams to a third absolute velocity less than said second absolute velocity, and having a respective axial velocity component, a respective tangential velocity component of substantially zero, and a respective radial velocity component of substantially zero; and (f) reuniting said third plurality of substreams into a third annulus of flowing fluid having said third absolute velocity including said third axial velocity component, said third tangential velocity component of substantially zero, and said third radial velocity component of substantially zero (substantially pure axial flow).

* * * * *